United States Patent [19]

McGuire

[11] 4,343,763

[45] Aug. 10, 1982

[54] HEAT TRANSFER SYSTEM

[75] Inventor: Joseph C. McGuire, Richland, Wash.

[73] Assignee: The United States of America as represented by the United States Department of Energy, Washington, D.C.

[21] Appl. No.: 128,203

[22] Filed: Mar. 7, 1980

[51] Int. Cl.[3] ..... G21C 19/00; F28D 15/00

[52] U.S. Cl. ..... 376/314; 376/367; 165/104.27; 165/104.14; 122/33; 376/311; 376/402

[58] Field of Search ..... 165/105, 104.27, 104.21, 165/104.14; 122/33; 376/314, 313, 367, 402

[56] References Cited

U.S. PATENT DOCUMENTS

| | | | |
|---|---|---|---|
| 2,119,091 | 5/1938 | Atbinson et al. | 165/105 X |
| 2,363,118 | 11/1944 | Chamberlain | 165/105 X |
| 3,633,665 | 1/1972 | France et al. | 122/33 X |
| 3,993,542 | 11/1976 | Blum et al. | 376/314 X |
| 4,072,183 | 2/1978 | Fraas | 165/105 X |
| 4,244,783 | 1/1981 | Corbett et al. | 376/313 X |

*Primary Examiner*—Albert W. Davis

*Attorney, Agent, or Firm*—Robert Southworth; Richard E. Constant; Richard G. Besha

[57] ABSTRACT

A heat transfer system for a nuclear reactor. Heat transfer is accomplished within a sealed vapor chamber which is substantially evacuated prior to use. A heat transfer medium, which is liquid at the design operating temperatures, transfers heat from tubes interposed in the reactor primary loop to spaced tubes connected to a steam line for power generation purposes. Heat transfer is accomplished by a two-phase liquid-vapor-liquid process as used in heat pipes. Condensible gases are removed from the vapor chamber through a vertical extension in open communication with the chamber interior.

3 Claims, 3 Drawing Figures

HEAT TRANSFER SYSTEM

BACKGROUND OF THE INVENTION

This disclosure relates to a sealed, refluxing heat transfer device adapted to replace the secondary or intermediate heat exchanger in a nuclear reactor used for generation of steam for power purposes. The present intermediate heat exchanger provides the required physical isolation between the primary reactor coolant loop and a secondary liquid loop in which steam is generated. It utilizes the available heat transfer rates common to a heat pipe, but requires no wicking materials. It further serves to physically isolate noncondensible gases, which can be readily recovered.

These results are accomplished by use of a sealed vapor chamber where the primary loop and the steam line are in proximity to one another, but not in contact. Heat transfer occurs within the vapor chamber by use of the two phase liquid-vapor-liquid process common to heat pipes.

It is a first object of this invention to provide an efficient intermediate heat exchanger for use in nuclear reactors which will effectively isolate steam generating equipment from possible contamination with radioactive materials. The intermediate heat exchanger also reduces the danger of catastrophy which would accompany any leak between the primary loop and the steam generating piping were they to be directly coupled to one another. This is of special significance in the design of liquid metal cooled reactors.

Another object of this disclosure is to provide an intermediate heat exchanger which eliminates the requirement of utilizing secondary liquid pumps and the problems of maintaining such pumps.

Another object of this invention is to provide an intermediate heat exchanger with no moving mechanical elements, and where all elements of the heat exchanger itself will be encased within a sealed vapor chamber. In many instances, the working pressure within the sealed vapor chamber will be less than atmospheric pressure. Rupture of the chamber will therefore not result in an explosive condition, since the reduced pressure within it will contain its elements and materials within its normal confines.

SUMMARY OF THE INVENTION

The intermediate heat exchanger is contained within a sealed vapor chamber that includes a bottom interior portion and an adjacent upper interior portion in vertical communication with one another. The chamber is exhausted of all noncondensible gases at ambient temperature. A heat transfer medium within the chamber maintains a two phase liquid-vapor-liquid system at the design heat transfer temperature. A first set of tubes in the bottom portion of the vapor chamber is supplied with primary reactor coolant. A second set of tubes in the upper portion of the chamber is supplied with water or steam. A thermal linkage is provided between the two sets of tubes by the heat transfer medium, which is evaporated in the vicinity of the first set and is condensed in the vicinity of the second set. This results in a latent heat transport system, condensate return being accomplished by gravity.

DESCRIPTION OF THE PREFERRED EMBODIMENT

According to this disclosure, the usual secondary system provided in a liquid metal cooled reactor is replaced by a vapor chamber wherein the primary loop and the steam line for power generation are in close proximity to one another, but not in physical contact. Heat transfer is accomplished between them by a two phase liquid-vapor-liquid process similar to that used in heat pipes.

A "heat pipe" is an evacuated tube or chamber containing a small amount of working fluid and used as a heat exchanger. Any heat applied to the heat pipe immediately results in an additional amount of vapor being generated within it. A corresponding amount of vapor quickly condenses on the first cold area encountered, releasing the heat of vaporization. As a result of this phenomenon, the heat pipe is essentially isothermal along its entire length and has the ability to conduct heat from place to place at a rate 1,000–1,500 times that of a bar of solid silver.

This disclosure utilizes the same heat transfer process within a vapor chamber where heat input is applied to a supply of heat transfer medium in a liquid phase at the bottom of the chamber. The heat is absorbed by the medium and transferred to an upwardly adjacent condenser area within the chamber by the resulting vapors. The vapors are condensed to release heat and resulting liquid is allowed to return by gravity to the bottom of the vapor chamber. The heat inlet and outlet piping are not in physical contact, which fulfills the requirement of liquid metal cooled reactors that there be physical isolation between the highly reactive primary coolant which is radioactive, and the water and steam system typically used for power generation.

Figure 1:
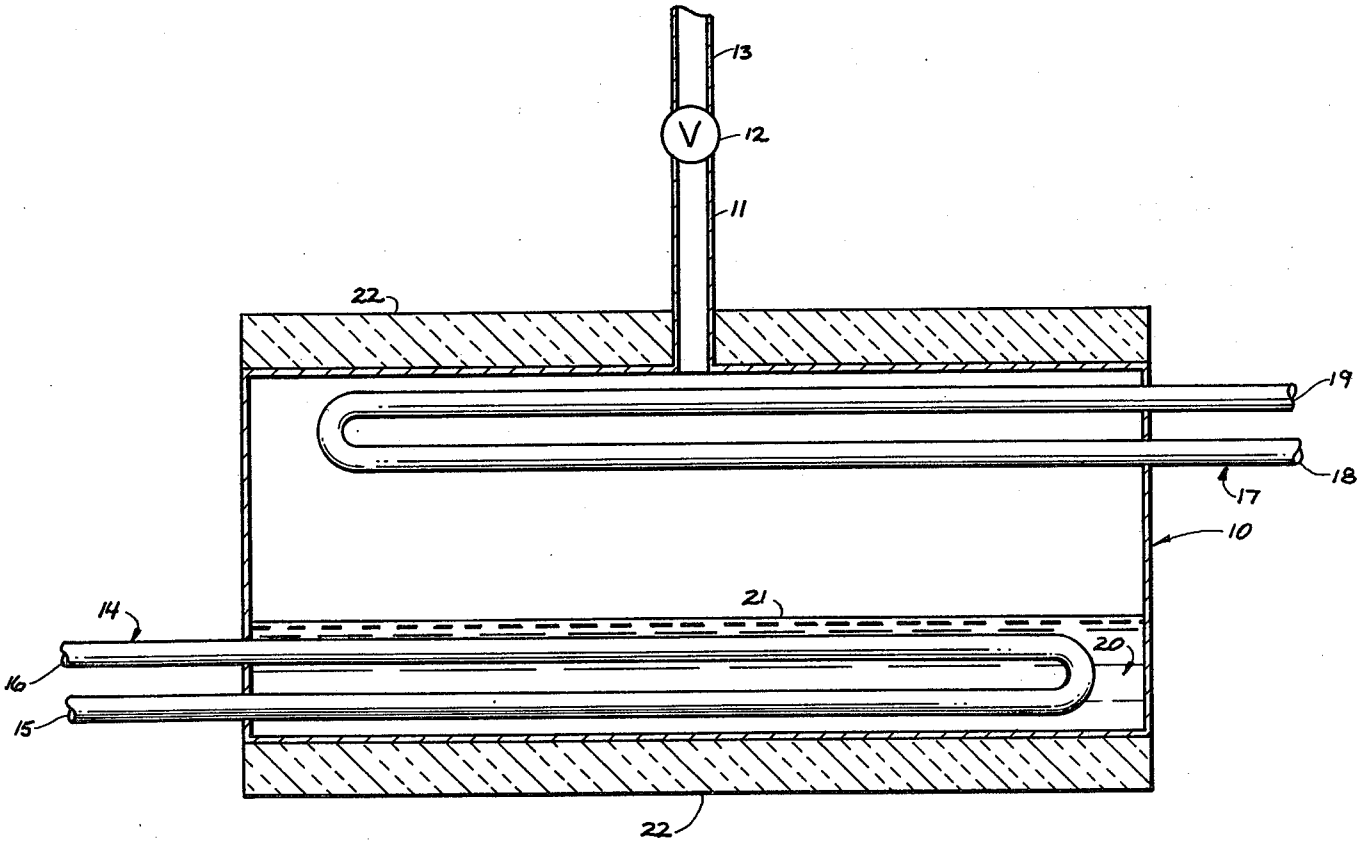
FIG. 1 is a schematic diagram of the intermediate heat exchanger.

FIG. 1 schematically illustrates the general details of the intermediate heat exchanger. It includes a sealed vapor chamber 10 having a restricted upper extension 11 in open communication with its top wall. Extension 11 is capped by a shutoff valve 12 connected by conduit 13 to auxiliary equipment described below.

Located within the bottom interior portion of the sealed vapor chamber 10 is a first heat transfer means, comprising a bundle of tubes schematically illustrated at 14. The tubes 14 are connected by inlet and outlet conduits 15 and 16 to the primary reactor coolant loop of the nuclear reactor (not shown).

Located immediately above the bundle of tubes 14 is a second bundle of tubes diagrammatically illustrated at 17. They are positioned within the upper portion of the vapor chamber and are supplied with water and/or steam by means of inlet and outlet conduits 18 and 19, which are connected to the secondary liquid loop in the power generation system operated by the nuclear reactor.

Heat transfer medium is provided within the vapor chamber 10. It includes a pool of liquid 20 having a liquid surface 21 that normally will not have an elevation higher than necessary to cover the uppermost tubes 14 in the normal equilibrium working condition of the system. The heat tranfer medium has a melting point below the design heat transfer temperature of the heat exchanger. The amount of heat transfer medium is such as to maintain a two phase liquid-vapor-liquid system within the vapor chamber 10 at the design heat transfer temperature.

Prior to its use, the interior of the vapor chamber 10 is exhausted of all noncondensible gases at ambient temperature. This will result in the production of a substantial vacuum within the chamber 10 to facilitate vaporization of the heat transfer medium when it has been elevated in temperature to the design heat transfer temperature of the system.

Heat transported to the interior of the vapor chamber from the reactor through the incoming conduit 15 will cause evaporation or vaporization of the heat transfer medium in the bottom portion of chamber 10. Simultaneously, the circulating water and/or steam delivered through conduit 18 to the upper interior portion of chamber 10 will cause the vapors to be condensed. By balancing the heat input and output of the system, the two phase heat transfer mechanism in the sealed vapor chamber 10 can be maintained in equilibrium, resulting in almost simultaneous transfer of heat without physical contact between the bundles of tubes shown at 14 and 17.

During the course of the very rapid heat transfer cycle within chamber 10, any noncondensible gas that is produced within the sealed enclosure, or which enters it from the circulating primary reactor coolant, will be swept away from the working area about the tubes 14 and 17 to a location farthest from the heat input zone at the bottom interior portion of chamber 10. This location, commonly termed the "cold zone" in heat pipe terminology, is provided within a vertical extension 11 in open communication with the top wall across chamber 10. Oxygen, nitrogen, carbon dioxide, hydrogen and any other non-condensible gases will collect within this area and can be removed by operation of the shutoff valve 12. Conduit 13 can be connected to either a vacuum system or to a recovery system, depending upon the working pressure within chamber 10.

The collection of noncondensible gases is of particular importance in relating this intermediate heat exchanger to a nuclear reactor. Any tritium produced in the reactor which diffuses through the walls of the tubes 14 and is released into the vapor chamber 10 can be recovered within extension 11 and isolated from the water-steam power generation equipment operatively connected to conduits 18, 19. The extension 11 can be monitored, and accumulated gas within it can be removed periodically to assure continual efficient operation of the vapor chamber.

Figure 2:
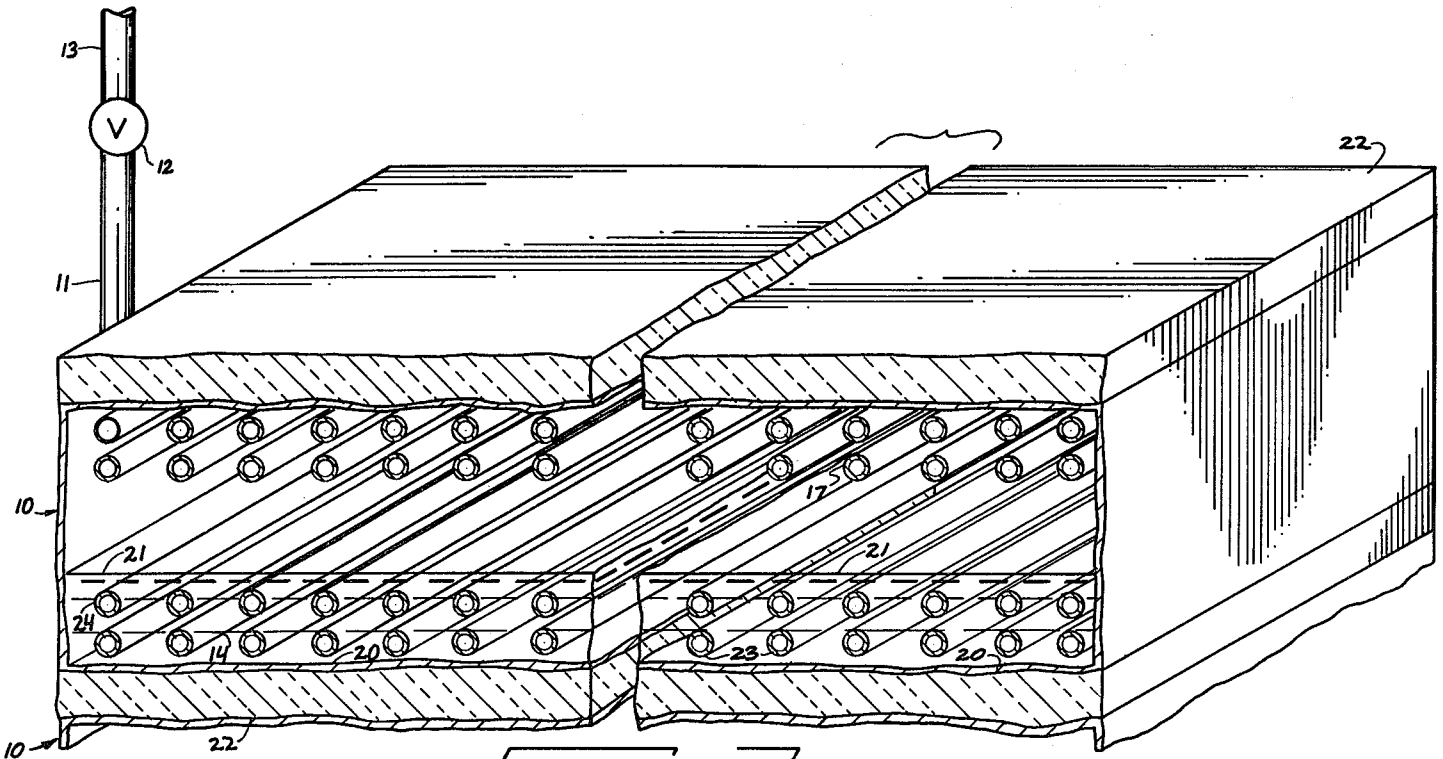
FIG. 2 is a fragmentary perspective view of one form of the heat exchanger.

An evaluation of potential vapor chamber heat exchanger designs for a liquid metal fast breeder reactor has yielded the structural design concept shown in FIG. 2. Each individual vapor chamber 10 is a rectangular sealed container about ten feet by twenty feet by four inches high. A plurality of vapor chambers 10 can be stacked as much as twelve high, yielding an intermediate heat exchanger "unit" about ten feet by twenty feet by five feet high. They would be separated by layers of insulation shown generally at 22. Each vapor chamber 10 is designed for transfer of at least 30 Mw. of heat or 360 Mw. per "unit".

Within each vapor chamber shown in FIG. 2 would be 118 primary coolant tubes 23 having an outside diameter of 0.875 inches and a length of 20 feet. Each chamber 10 would also be provided with 118 steam generator tubes 24 of the same dimensions for heat removal. The twenty foot chamber can be divided into three laterally adjacent sections operating at slightly different design heat transfer temperatures for preheat, evaporation and super heat conditions.

In the proposed vapor chamber, the working fluid at design heat transfer temperature would be 1.75" deep or would have a volume of 544 liters. The heat transfer at the working fluid surface would be 161 watts/cm$^2$ and the heat transfer at the surfaces of the input tubes to the working fluid would be 59.7 watts per cm$^2$.

Because of stress problems, a rectangular chamber may not always be practical, even where the vapor chambers are stacked with curved reinforcing plates at the top and bottom of each "unit". Alternative designs may include an elliptical cross section for each vapor chamber, with the vapor chambers stacked in a generally hexagonal or rectangular pattern to conserve space and to shorten the inlet and outlet connecting lines to the nuclear reactor and power generation equipment, respectively. In this arrangement, the total volume of space required by the intermediate heat exchanger would be increased, but the ratio of working fluid required in relation to heat capacity per unit would remain generally the same as in the rectangular example.

The heat transfer medium in this system must be operational at a design heat transfer temperature in the range of 420°–550° C. Suitable media include potassium, mercury, cesium, yellow phorphorus, sulfur, and fused salts. The use of molten salts as vaporizable heat transfer media is particularly appealing for liquid metal fast breeder reactor heat exchanger applications because of reduced hazards in the event of working fluid contact with either air, water or sodium. Molten salt working fluids must satisfy several criteria. These include:

(1) Satisfactory heat transfer coefficients;
(2) Adequate vapor pressure
(3) Compatabilities with containment materials;
(4) Adequate thermal stability;
(5) Low toxicity;
(6) Low cost.

Most of the potential molten salt working fluids are halide or nitrate salts such as aluminum bromide ($AlBr_3$), bismuth trichloride ($BiCl_3$), and silver nitrate ($AgNO_3$).

Appropriate construction materials and working fluids are available for heat transfer applications using the above system in design heat transfer temperatures from minus 50° to 2000° C.

The heat transfer within chamber 10 is isothermal and almost instantaneous. The limiting factor for quantity of heat moved between the tubes 14 and tubes 17 is the temperature differential between them and the surface area across the working fluid surface 21. In heat pipes, performance can be "choked" by the vapor reaching sonic velocity. For the three fluid metals, mercury, potassium and cesium, these sonic velocity limits are listed in Table 1.

TABLE 1

| | | Sonic Power Limit Watts/cm$^2$ | |
|---|---|---|---|
| T °C. | Hg | K | Cs |
| 400 | 20,780 | 185 | 329 |
| 450 | 40,000 | 500 | 800 |
| 500 | 72,750 | 1,280 | 1,749 |

TABLE 1-continued

| T °C. | Hg | Sonic Power Limit Watts/cm² K | Cs |
|---|---|---|---|
| 540 | 112,700 | 2,300 | 2,900 |

For a 10′ by 20′ surface 21, the 30 Mw of power would be transferred at the rate of 161 watts/cm². If the average transfer temperature is 500° C., it will be apparent from Table 1 that the sonic limit of the fluid is not a factor that needs to be considered for the metals proposed as working fluids. Similar considerations must be taken into account when selecting a suitable molten salt working fluid.

The choise of working fluid must be evaluated with respect to each reactor installation. The following will specifically relate to the three metals, potassium, mercury and cesium, which have suitable vapor pressure and heat transfer properties at the temperature range of 420°–550° C.

The detailed chemical properties of potassium as an alkali metal are well known and need not be detailed herein. The general characteristics of potassium are:

| | |
|---|---|
| Density - .86 (20° C.) | .74 (500° C.) g per cc |
| Melting point | 62.3° C. |
| Boiling point | 760° C. |
| Heat of vap. @ 500° C. | 500 cal/gm |
| Vap. press. @ 500° C. | ~50 torr |
| At a power of 30Mw | |
| Distillation rate | 20.085 Kg/sec. |
| Volume for 1 chamber (3 sections) | 544.341 liters |
| Wt. for 1 chamber | 402.813 Kg. |

The advantages of potassium in the vapor chamber system are that it is a light metal and has a high heat of vaporization per mole. Apparent disadvantages are the possibilities of a violent reaction of the potassium with water that might escape from the upper bundle of tubes 17. It also has a very low vapor pressure at the proposed operating temperatures of approximately 500° C. Potassium further exhibits questionable compatability with structural materials required in the construction of the vapor chamber 10.

Mercury is a heavy toxic material. It is a cumulative poison which must be handled by personnel with utmost care. It makes an excellent heat pipe fluid if all heat input surfaces are wetted. Potential corrosion of contacted surfaces can be inhibited by addition of ten parts per million of titanium. Wetting of contacted surfaces can be promoted by addition of small amounts of magnesium. The general characteristics of mercury relative to this system are:

| | |
|---|---|
| Melting point | −38.87° C. |
| Boiling point | 356.9° C. |
| Heat of vap. | 755 Cal/cc @ 500° C. |
| Vap. press. @ 500° C. | ~7 atmospheres |
| Distillation rate @ 30Mw | 102.8 Kg/sec. |
| Volume for 1 chamber (3 sections) | 544.341 liters |
| Wt. for 1 chamber | 7,737 Kg. |

The advantages to the choice of mercury as a working fluid are that it is non-reactive with water and exhibits very efficient heat transport capability. It also has a high vapor pressure and is the one proposed fluid which would exhibit a positive pressure within the working vapor chamber 10. Its disadvantages are its toxic qualities, its relative weight, and its questionable compatability with other materials required in the structure of the vapor chamber 10.

The pertinent general characteristics of cesium are:

| | |
|---|---|
| Melting point | 26° C. |
| Boiling point | 670° C. |
| Heat of vap. | 518 cal/gm |
| Vapor press. @ 500° C. | 83 torr |
| Distillation rate @ 30Mw | 58.078 Kg/sec. |
| Volume for 1 chamber (3 sections) | 544.341 liters |
| Wt. for 1 chamber | 637.670 Kg. |

The advantages of choosing cesium as the heat transfer medium relate to its high heat of vaporization per mole and higher vapor pressure at the design heat transfer temperature in relation to the vapor pressure of potassium. It is also liquid at normal room temperature and has a high sonic limit. The disadvantages of selecting cesium relate to its high reactivity, its relatively high cost and questionable compatability with respect to exposed chamber surfaces.

A small glass prototype of the vapor chamber heat transfer system has been tested. An internal electric heater was utilized to simulate the primary sodium heat loop of a liquid metal cooled reactor. Water was used as both working fluid and coolant. Data were obtained comparing both circulated and static liquid heat transfer to the vapor chamber. These data indicate that heat is transferred more efficiently by the vapor chamber system than by static or circulated liquid conduction systems.

Figure 3:
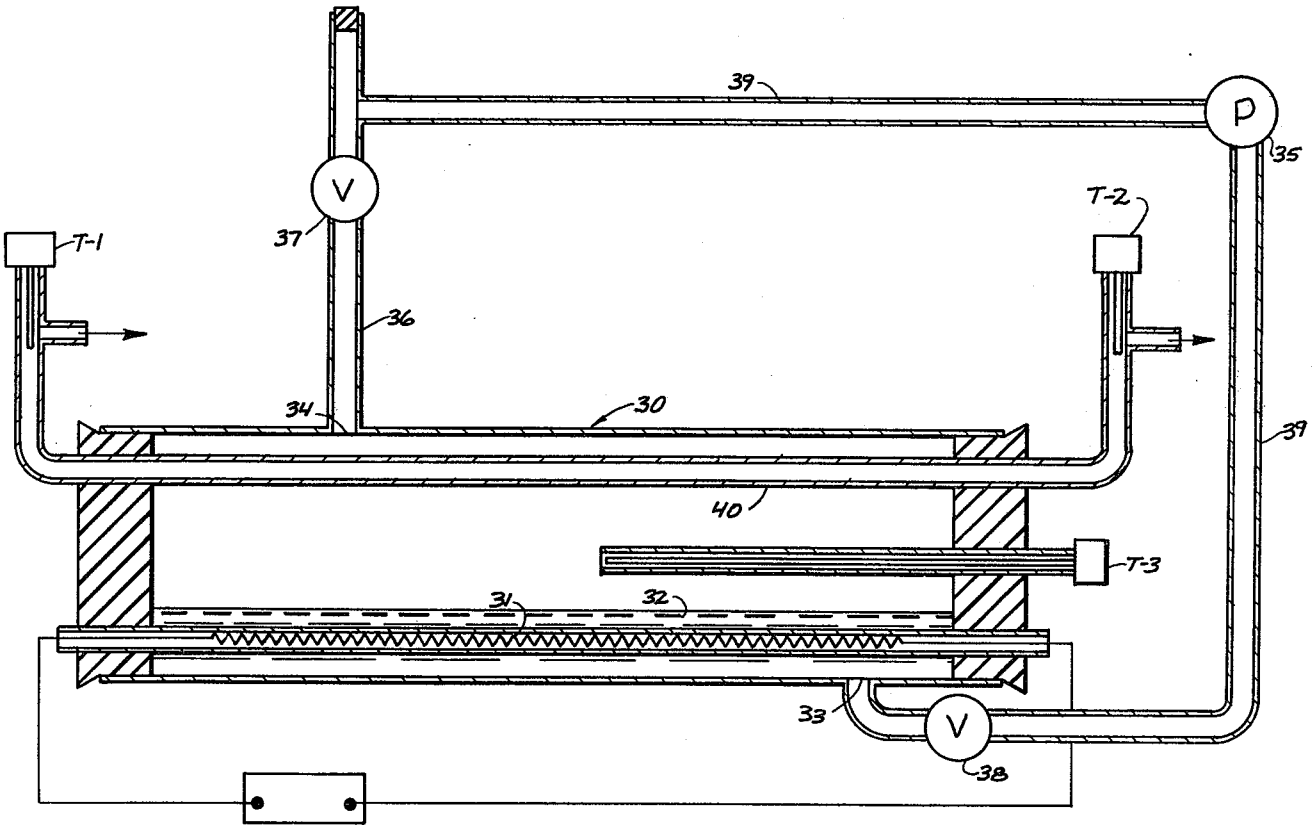
FIG. 3 is a schematic view of a laboratory test model of the heat exchanger.

As seen in FIG. 3, the apparatus consisted of a 14″ cylindrical chamber of 38 mm o.d. pyrex glass tube 30. Heat, representing the primary sodium system input, was provided by an electrical resistance heater 31 inside the tube 30 and running longitudinally through the chamber at the bottom portion of tube 30. In this way, all heat generated by the heater 31 was provided to the heat transfer liquid 32 except for the small amount conducted out the ends of the tube 30.

The chamber was provided with inlet and outlet connections 33,34 so that it could be operated full of water in either a static or a circulating mode and as a vapor chamber. For vapor chamber operation, the water was drained to the desired level, then evacuated with a mechanical pump (not shown). During this evacuation, the water boiled, releasing dissolved gases. After a preliminary evacuation, the chamber was sealed, heat applied, and the resulting "heat pipe" operation isolated remaining dissolved and occluded noncondensible gases in the vertical connecting tube 36. While in operation, these remaining gases were removed by a quick evacuation.

For operation filled with water, the comparison of static to pumped flow was provided by a rubber tube connecting the upper and lower chamber seal stopcocks 37,38. A rubber tube 39 was run through a "finger pump" 35, a mechanical device providing fluid flow inside rubber tube by a series of metal fingers operating in a travelling sine wave. The speed of the pump 35 was controllable from 0 to 1000 cm/min. Using this device assured minimal heat loss in the circulating liquid and no chance for contamination of the liquid by contact with pump parts. Static conditions involved simply turning off the pump 35 and closing the lower stopcock 38.

Heat was removed from the system by water running through the upper longitudinal tube 40 shown in FIG. 3. The temperature of the inlet water was measured at point T-1 and the outlet at T-2. Flow was determined by volume measurement as a function of time. Power input was determined from input voltage and amperage, and power output by temperature rise and volume flow. The temperature within the chamber was measured at the thermowell T-3.

Using a range of coolant flows from 30 to 350 cc/min. heat transfer efficiencies were determined for both vapor chamber and direct liquid operation. Early in the investigation, it became evident that the circulated liquid was about 10% less efficient than the static liquid, apparently due to heat losses in the rubber tubing; therefore, all comparisons are between static liquid and vapor chamber. Typical experimental results are shown in Table 2.

TABLE 2

HEAT TRANSFER EFFICIENCIES

| Vapor Chamber | Input Power Watts | Output Power Watts | Efficiency |
|---|---|---|---|
| Coolant Flow cc/min. | | | |
| 75 | 151.8 | 120.4 | 79.3 |
| 70 | 151.8 | 122.1 | 80.4 |
| 92 | 151.8 | 138.0 | 90.9 |
| 88 | 151.8 | 130.5 | 86.0 |
| 147 | 151.8 | 123.1 | 81.1 |
| 128 | 151.8 | 125.1 | 82.4 |
| 120 | 151.8 | 125.6 | 82.7 |
| 97 | 152 | 123.5 | 81.3 |
| 86 | 148 | 123.0 | 83.1 |
| 112 | 148 | 125.1 | 84.5 |
| 104 | 148 | 137.9 | 93.2 |
| Static Liquid | | | |
| 127 | 164.7 | 119.6 | 72.6 |
| 120 | 164.7 | 129.8 | 78.8 |
| 116 | 164.7 | 137.6 | 83.5 |
| 103 | 164.7 | 122.2 | 74.2 |
| 101 | 167.0 | 123.3 | 73.8 |
| 90 | 167.0 | 130.0 | 77.8 |
| 82 | 167.0 | 134.5 | 80.5 |
| 244 | 168.2 | 127.7 | 75.9 |
| 224 | 168.2 | 132.7 | 79.0 |
| 166 | 168.2 | 127.4 | 75.9 |
| 102 | 168.2 | 121.0 | 71.9 |
| 47 | 162.7 | 136.1 | 83.6 |

Eliminating the highest and lowest readings in each set, the average efficiencies are:

| | |
|---|---|
| Vapor Chamber | 83.6% |
| Static Liquid | 77.2% |

These first experiments indicate that the vapor chamber system is superior to the static liquid in heat transport.

The difference in thermal efficiencies between the vapor chamber and the static liquid system is partly or wholly explained by the formation of gas bubbles on the heat input tube surface during all liquid operation. These bubbles appear to block a significant area of the heat input surface, causing lowered heat transfer into the system.

When considering vapor chamber mode operation, the level of working fluid was originally considered to be critical. In tests, it was determined that the working fluid level can be much lower. Tests with the working fluid in contact with only the lower $\frac{1}{3}$ of heat input tube gave efficiencies as good as those seen when working fluid covered the heat input. This phenomenon seems to be due to the boiling activity of the working fluid which keeps the entire input tube wet even when the liquid is low.

Taking into consideration the isothermal operation of a vapor chamber, it appears that a series of three short chambers would provide the temperature differential required for efficient heat transfer from the reactor core of a liquid metal fast breeder reactor. As an example, these chambers could be designed to operate at 1050° F., 950° F., and 800° F., respectively, offering a preheater, an evaporator, and a super heater to the steam line at the upper interior portion of the paper chamber 10.

The adoption of the vapor chamber concept in nuclear reactor design could lead to economies not only in structural materials, complexity and size, but might also provide the production of hotter steam at the turbines, since this intermediate heat exchanger would eliminate one of the two conventional heat exchangers needed in systems in use today. The vapor chamber heat exchanger might also be suitable for use as an emergency heat dump system for a reactor and for other applications requiring rapid response for heat transfer at both high and low levels.

While the system has been described specifically with respect to liquid metal cooled reactors, it is equally applicable to pool or loop-type reactors, as well as to light water reactors.

Having described my invention, I claim:

1. A method for operating a nuclear reactor having a primary reactor coolant loop and a secondary liquid loop comprising:

(a) providing a sealed vapor chamber including a bottom interior portion and an adjacent upper interior portion in vertical communication and close physical proximity with one another;

(b) exhausting all noncondensible gases at ambient temperature from the interior of the vapor chamber;

(c) placing heat transfer medium within the vapor chamber having a melting point below the design heat tranfer temperature in an amount sufficient to maintain a two phase liquid-vapor-liquid system within the vapor chamber at the design heat transfer temperature;

(d) operatively arranging a first heat transfer means in the primary reactor coolant loop and physically positioned within the bottom interior portion of the vapor chamber for transferring heat from the primary reactor coolant loop to the heat transfer medium;

(e) operatively arranging a second heat transfer means in the secondary liquid loop and physically positioned within the upper interior portion of the vapor chamber for transferring heat from the heat transfer medium to the secondary liquid loop; and (f) selectively withdrawing tritium from an extension in open communication with the vapor chamber.

2. An intermediate heat exchanger unit for a nuclear reactor that includes a primary reactor coolant loop and a secondary liquid loop consisting of:

a plurality of vertically stacked vapor chambers, wherein;

each vapor chamber includes a bottom interior portion and an adjacent upper interior portion in vertical communication and close physical proximity with one another;

the interior of the vapor chamber is exhausted of all noncondensible gases at ambient temperature;

heat transfer medium is contained within the vapor chamber and has a melting point below the design heat transfer temperature, the amount of heat transfer medium being such as to maintain a two phase liquid-vapor-liquid system within the vapor chamber at the design heat transfer temperature; and first heat transfer means is operatively arranged in a primary reactor coolant loop and physically positioned within the bottom interior portion of the vapor chamber for transferring heat from the primary reactor coolant loop to the heat transfer medium.

3. The intermediate heat exchanger unit of claim 2 wherein said vapor chamber is a rectangular sealed container about ten feet wide, about twenty feet long and about four inches high.

* * * * *